US005600938A

United States Patent [19]

Trimble

[11] Patent Number: 5,600,938

[45] Date of Patent: Feb. 11, 1997

[54] SEALING AND BAGGING APPARATUS AND METHOD

[75] Inventor: Don K. Trimble, Vashon, Wash.

[73] Assignee: Kwik Lok Corporation, Yakima, Wash.

[21] Appl. No.: 532,430

[22] Filed: Sep. 22, 1995

[51] Int. Cl.[6] ..... B65B 51/00

[52] U.S. Cl. ..... 53/417; 53/138.3; 53/138.4

[58] Field of Search ..... 53/417, 418, 371.4, 53/374.4, 479, 138.3, 138.4, 138.5; 156/251, 252, 253, 513, 515

[56] References Cited

U.S. PATENT DOCUMENTS

| | | | |
|---|---|---|---|
| 121,646 | 12/1871 | McGrane . | |
| 2,545,243 | 3/1951 | Rumsey, Jr. | 18/56 |
| 2,783,599 | 3/1957 | Weikert | 53/30 |
| 2,849,171 | 8/1958 | O'Brien, Jr. | 229/63 |
| 3,038,651 | 6/1962 | Cloudsley | 229/55 |
| 3,111,794 | 11/1963 | Spolsino | 53/14 |
| 3,115,564 | 12/1963 | Stacy | 219/19 |
| 3,311,288 | 3/1967 | Lemelson | 229/65 |
| 3,358,905 | 12/1967 | Soesbergen | 229/62 |
| 3,372,797 | 3/1968 | Grevich | 206/56 |
| 3,432,980 | 3/1969 | Seiferth et al. | 53/14 |
| 3,471,005 | 10/1969 | Sexstone | 206/41 |
| 3,510,380 | 5/1970 | Bittner et al. | 156/515 |
| 3,540,184 | 11/1970 | Ashton | 53/14 |
| 3,633,247 | 1/1972 | Clayton | 24/30.5 PB |
| 3,719,736 | 3/1973 | Woodruff | 264/156 |
| 3,759,438 | 9/1973 | Ruda | 229/65 |
| 3,788,933 | 1/1974 | Seinosuke Nakazawa | 156/513 |
| 3,837,976 | 9/1974 | Davidsson | 156/513 |
| 3,974,960 | 8/1976 | Mitchell | 229/62 |
| 4,159,077 | 6/1979 | Hall | 229/62 |
| 4,172,349 | 10/1979 | Lipes | 53/459 |
| 4,188,769 | 2/1980 | Bright, Jr. | 53/434 |
| 4,242,171 | 12/1980 | Kauer et al. | 53/417 |
| 4,249,361 | 2/1981 | Tetenborg et al. | 53/417 |
| 4,291,517 | 9/1981 | Lipes | 53/468 |
| 4,364,511 | 12/1982 | Wittern et al. | 53/417 |
| 4,398,379 | 8/1983 | Burford | 53/138.3 |
| 4,682,976 | 7/1987 | Martin et al. | 53/551 |
| 4,706,298 | 11/1987 | Lipes | 383/71 |
| 4,723,390 | 2/1988 | Duke | 53/374.4 |
| 4,758,297 | 7/1988 | Calligarich | 156/251 |
| 4,989,391 | 2/1991 | Wetter | 53/131 |
| 5,177,939 | 1/1993 | Lipes | 53/572 |
| 5,199,794 | 4/1993 | Lipes | 383/71 |
| 5,329,745 | 7/1994 | Suga | 53/75 |

FOREIGN PATENT DOCUMENTS

| | | | |
|---|---|---|---|
| 0747241 | 11/1966 | Canada | 53/138.3 |
| 2307354 | 2/1973 | Germany | 53/138.3 |
| 2034278 | 6/1980 | United Kingdom | B85D 77/14 |

*Primary Examiner*—Lowell A. Larson
*Assistant Examiner*—Gene L. Kim
*Attorney, Agent, or Firm*—Seed and Berry LLP

[57] ABSTRACT

Apparatus for sealing a plurality of spaced spots across the flattened open end of a filled plastic bag, the bag is moved along a conveyor past a sealing mechanism where a plurality of spaced spots are welded or fused across the open end of the bag, the bag is then moved to a bag closing device where the bag neck is gathered and a removable closure attached to the gathered neck of the bag. The method includes moving a filled bag to a sealing unit where a plurality of spaced spots are placed across the flattened open end of the bag, the partially sealed bag has its open end gathered, and the bag moved to a closing station where a removable closure is placed around the gathered neck of the bag.

16 Claims, 5 Drawing Sheets

SEALING AND BAGGING APPARATUS AND METHOD

TECHINICAL FIELD

The present invention relates to partially sealing and closing plastic bags of the type in which the neck of the open end of the bag is gathered and closed by a removable closing device and the closed bag can be reopened. The partially sealed open end of the bag is sealed along a line of spaced spots which can be separated to allow the bag to be opened without destroying the bag and then have the neck again be gathered and reclosed by the closing device.

BACKGROUND OF THE INVENTION

Bags which have the neck of their open ends gathered and closed by a plastic clip, wire, or plastic twist around the gathered bag neck are known. It is also known to heat seal a closed seal across the entire open end of a bag. It is also known to close the gathered end or neck of the bag by using fused sealing lines which are formed by pushing heated pins through the gathered folds of the gathered neck of the bag.

SUMMARY OF THE INVENTION

It is a feature of this invention to provide a plurality of spaced fused sealing spots across the bag opening of the open end of a plastic bag to form a partial seal that if broken will indicate the bag has been previously opened and then to gather the neck of the bag and completely close the bag. In the preferred form of the invention, the bag neck is gathered and closed with a plastic closure between the partially sealed spots and the contents of the bag.

In the preferred embodiment, the partial sealing of the bag is done by fusing or welding together at spaced spots the two layers of the bag that form the opening of the bag using heated pins that weld or fuse the spaced spots across the open end of the bag.

One aspect of the invention is to move along on a conveyor along a path past a sealing mechanism a plastic bag having a bag opening at its flattened open end and containing a product. The sealing mechanism then places spaced spots, preferably fused spots, across the flat open end to seal the two layers of the bag together at spaced locations across the open end of the bag. Next, the partially sealed bag open end is gathered and a removable bag closure is placed around the gathered end or neck of the bag, at a location closer to the product than the partially sealed spots. If the bag is once opened, the sealed spots will be separated and this will be apparent to the user. The bag, after the sealed spots have been opened, can be regathered and closed again with the removable closure. By placing the closure closer to the product, less stress is placed on the sealed spots making them less likely to be inadvertently separated and the package generally can be made tighter around the product in the bag. Various forms of sealing will be apparent. One form disclosed is to use a plurality of heated pins which penetrate the two layers of the open end of the bag while the end of the bag is substantially flat. These pins then move along with the bag in synchronism with the conveyor while the fusing occurs. In another embodiment, the sealing is accomplished by using a wheel having heated pins around its periphery and the wheel is rotated so that its tangential speed is in synchronism with the conveyor to successively make spaced fused spots across the generally flat open end of the bag.

The method of the invention includes moving the filled bag containing usually an edible product along a path past a sealing station, partially sealing the bag opening at a plurality of spaced spots across the open end of the bag from the forward edge of the bag to the rearward edge of the bag, gathering the neck of the open end of the bag, and then closing the bag gathered neck opening with a removable closure downstream of the sealing station. In the preferred embodiment, the closure is placed closer to the edible product, in from the end of the open end of the bag than is the line of sealing spots.

DETAILED DESCRIPTION OF THE INVENTION

Figure 1:
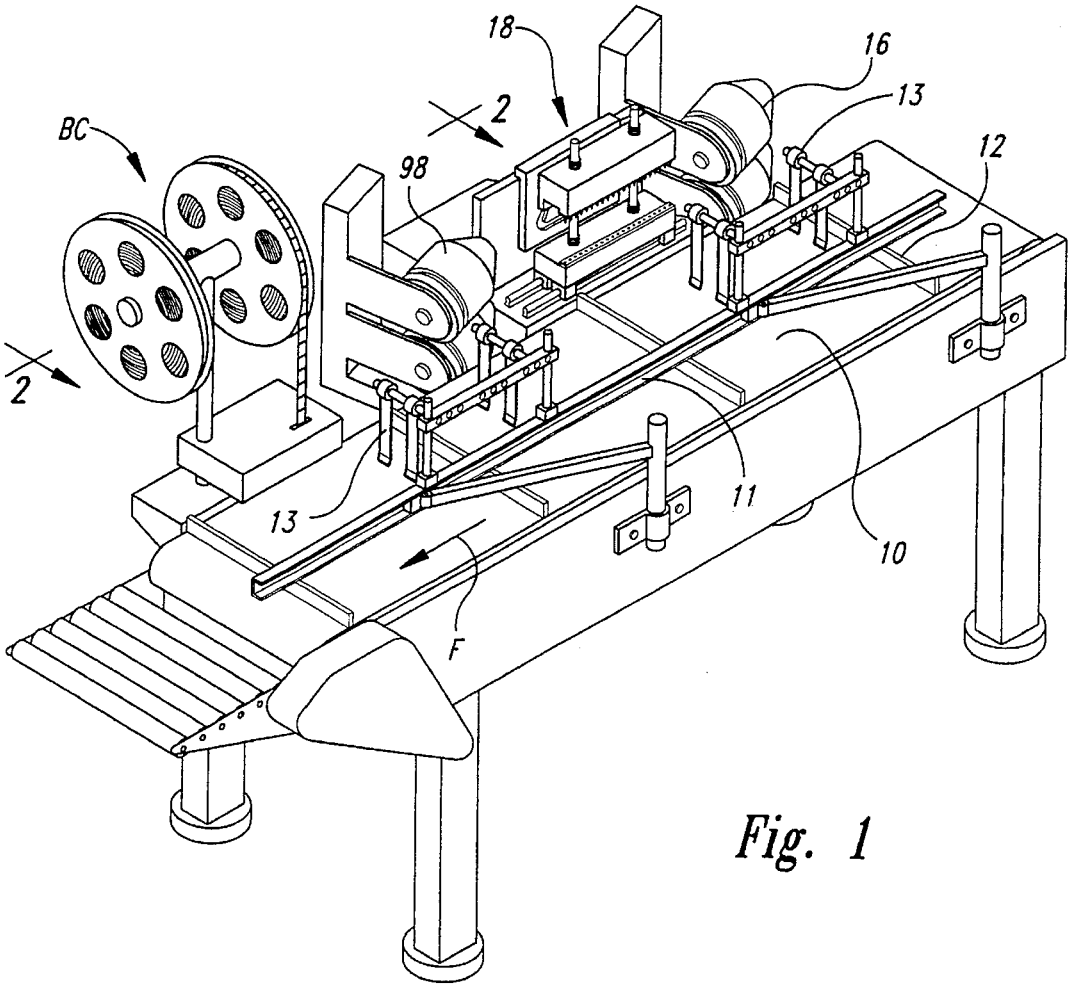
FIG. 1 is a schematic isometric illustrating an apparatus capable of carrying out the method of the invention.
Figure 2:
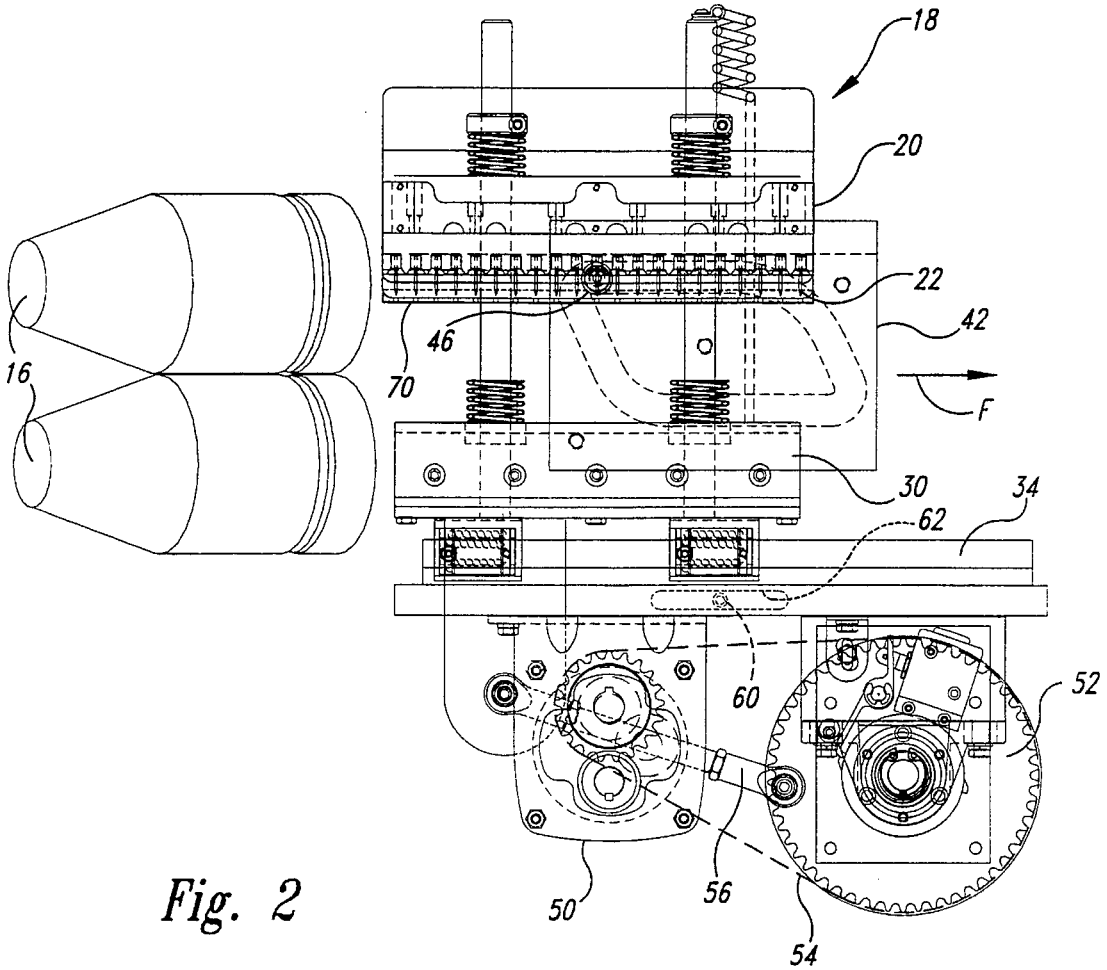
FIG. 2 is a rear view looking in the direction of the arrows 2—2 of FIG. 1.

As best shown in FIGS. 1 and 2, the apparatus includes a conveyor having flight bars 12 that move a plastic bag B filled with a product P. The product is usually an edible product, such as bread or rolls, but could be other types of product.

Bags of this type normally have an open end OE and a closed end CE. The open end may have holes 14 which are used to mount a plurality of empty bags on wickets (not shown). After the bag is filled the bag is pulled from the wicket, which will tear the hole 14.

The filled bag is moved along the conveyor in the direction of the arrow F with the closed end of the bag moving along an adjustable guide rail 11. Flexible bars 13 push the bags against the flight bars 12 to straighten the bags on the conveyor. Preferably, a set of brushes 16 engage the open end of the bag as the bag open end passes on the conveyor to flatten the open end and draw the bag upwardly as shown on the illustration of FIG. 4.

These brushes 16, are conventional and rotate in counter-rotational directions to engage the end of the bag in the nip of the brushes for positioning and flattening the end of the bag for the sealing mechanism.

A sealing mechanism 18 in the embodiment of FIGS. 1–6, includes a movable plate 20 (FIGS. 2 and 3) provided with a plurality of heated pins 22. The pins can be heated by any suitable means such as conventional electric heat rods 24 mounted in a heat sink bar 26. The pins are removable for replacement.

The movable plate 20 is slidable vertically on guide rods 28. These guide rods are also attached at their lower end to a lower platen plate 30. The platen plate reciprocates horizontally in guide tracks 34 that are fixed to a frame 36 that positions the platen plate alongside the conveyor 10. The platen plate is provided with a silicon pad 38 having holes 40 (FIG. 6A) formed to receive the end of the pins 22.

Figure 1A:
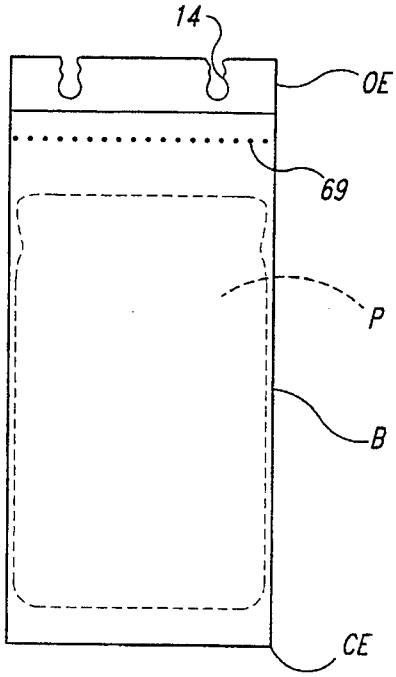
FIG. 1A shows a bag containing a product and with a line of sealing spots across the flattened open end of the bag.
Figure 2A:
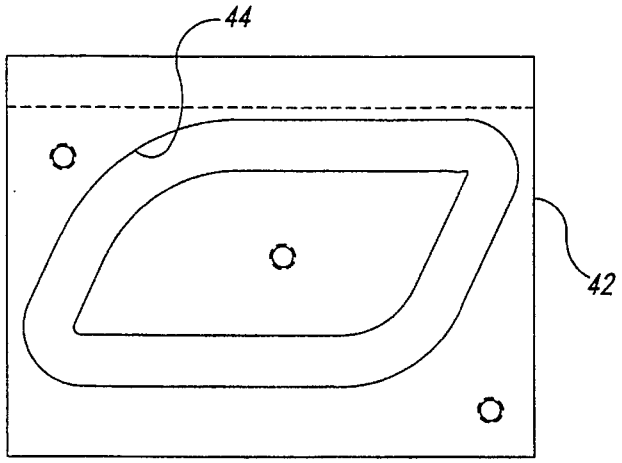
FIG. 2A is a fragmentary front illustration of a cam plate used in the apparatus of the embodiment of FIG. 2.
Figure 3:
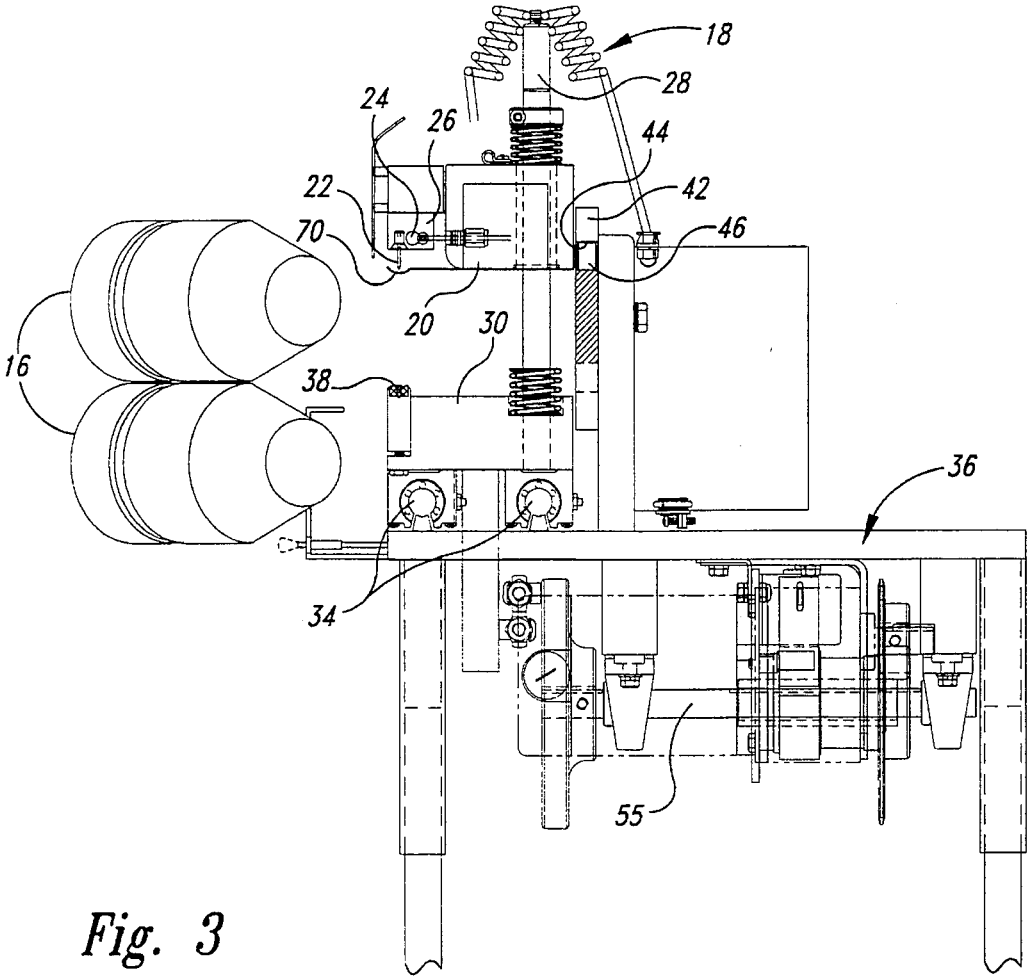
FIG. 3 is an end view of the apparatus shown in FIG. 2.

A cam plate 42 is fixed to the frame and has a cam slot 44 (FIG. 2A). A cam follower 46 is rotatably mounted to the movable plate and rides in the cam slot. When the movable plate and platen plate are slid along the tracks 34, the cam follower moves the movable plate down quickly to push the heated pins into the silicon pad 38, thus penetrating the two layers of the open end of the plastic bag and sealing spaced spots across the open end of the bag, from the forward edge of the bag to the rearward edge as shown, for example, in FIGS. 1A and 6B. The cam slot allows the plates to move into engagement as the plates move at the same speed in the same direction as the conveyor. After the sealing occurs the plates are moved upstream and cam follower 46 rides up in the cam slot to move the moveable plate 20 to a raised position where it is returned to its initial starting point along the guide track.

The plates 20 and 30 are slid along the tracks 34 by a motor 50 that drives a conventional solenoid actuated single revolution clutch 52 through a chain drive 54. The clutch has an output shaft 55 that is joined to the lower platen plate 30 by an eccentrically mounted rod 56. As is well understood with this type of drive, the motor 50 will run continuously and the clutch will be engaged to rotate one revolution upon a signal received that a bag is in position to be sealed. This signal is provided in the embodiment illustrated by a conventional photo sensor 60 that senses the presence of the leading edge of a bag passing the sensor thus sending the signal to the single revolution clutch to activate the sealing operation. The sensor is adjustably mounted in a slot 62 for adjusting the timing of the beginning of the sealing operation dependent upon the speed of the conveyor.

Figure 6A:
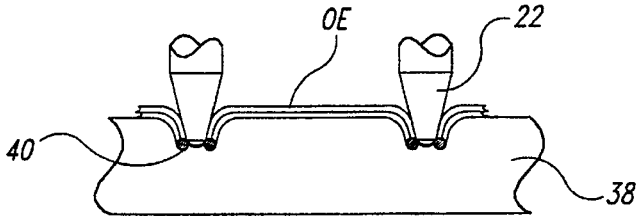
FIG. 6A is a detailed fragmentary showing an enlarged portion of the sealing mechanism of the apparatus of FIG. 2.
Figure 6B:
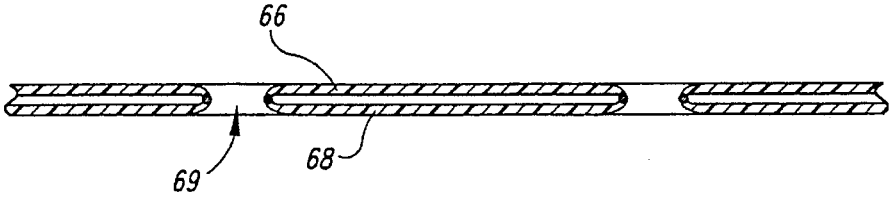
FIG. 6B is an enlarged fragmentary illustration showing the fused spots formed across the bag.

As best shown in FIGS. 6A and 6B, the seal tends to be a doughnut-shaped seal joining the two layers 68 and 66 of the plastic together in a generally doughnut-shaped hole 69. These holes are spaced across the open end of the bag as shown in FIGS. 1A and 6B leaving air passages between the unsealed layers of plastic.

A stripper plate 70 applies pressure on the bag to hold the layers of the bag together during the sealing to obtain a more consistent seal and has holes aligned with the pins 22 to strip off the pins any melted plastic from the bags.

Figure 7:
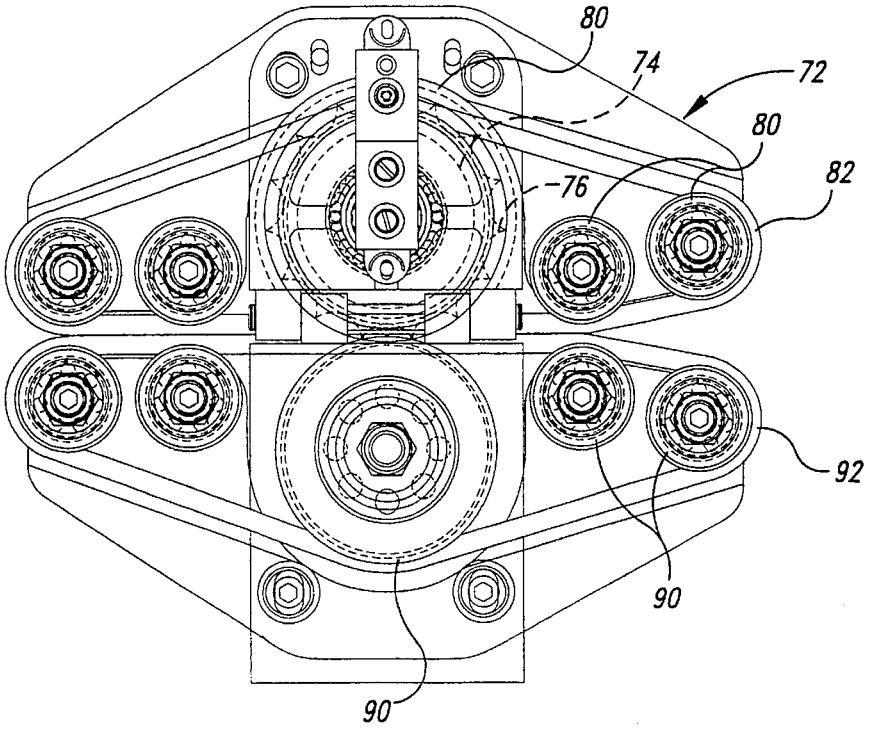
FIG. 7 is a front view of a second embodiment of the invention showing a wheel sealing mechanism with sealing pins on its periphery.
Figure 8:
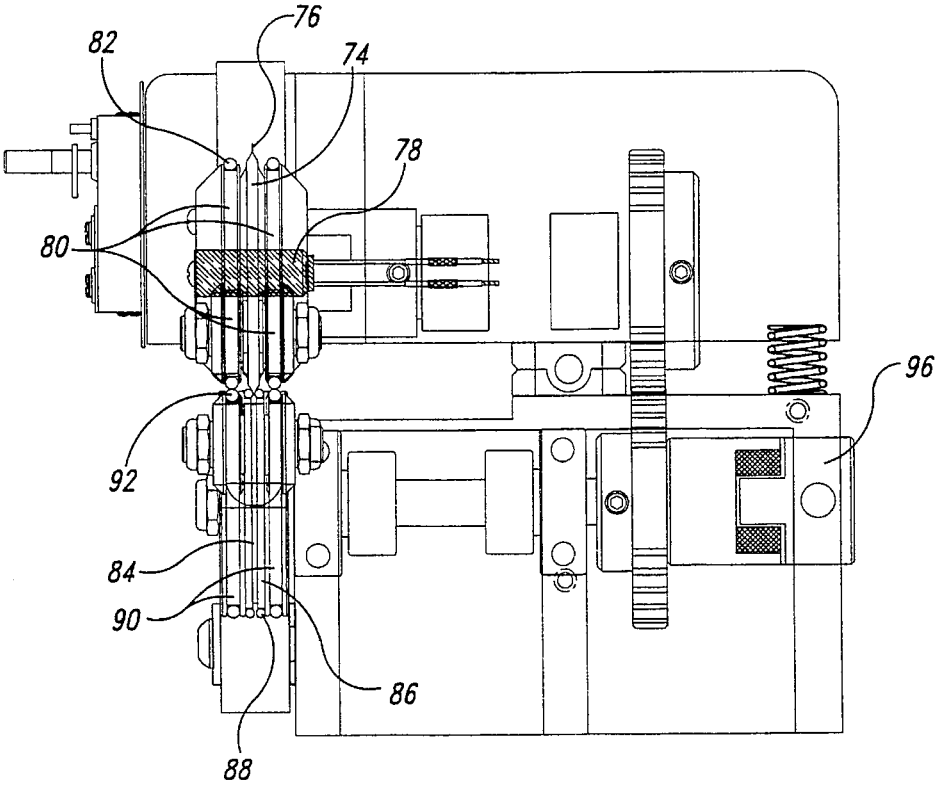
FIG. 8 is an end view of the wheeled sealing mechanism of FIG. 7.

As best shown in FIGS. 7 and 8, a second embodiment of the invention includes a sealing mechanism 72 positioned at the same location on the conveyor as the sealing mechanism 18. In this embodiment, the sealing mechanism includes a wheel 74 having a plurality of pins 76 spaced around its periphery. The wheel is heated by electric heat rods 78. A plurality of guide discs 80 are located on either side of the wheel. An O-ring 82 is entrained around the guide discs 80. The wheel 74 is aligned above a rotating platen wheel 84 that has a set of platen discs 86 attached to it, each with a small O-ring 88 that are spaced closely together. The O-rings 88 are spaced closely so that as the pins 76 come into contact with the O-rings the O-rings wipe the pins free of any melted plastic that has been fused. A plurality of lower guide discs 90 have O-rings 92 entrained thereon. The O-rings 82 and 92 serve to hold the open end OE of the bag flat and move it past the wheel 74.

Figure 1B:
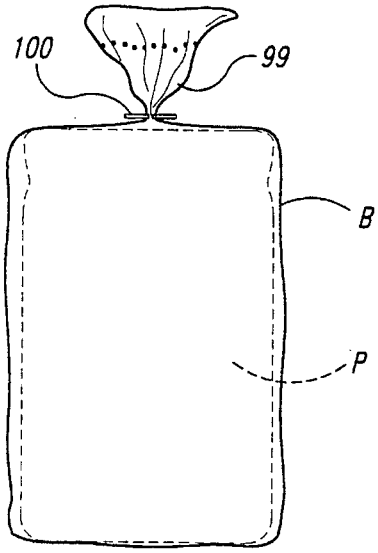
FIG. 1B shows the partially sealed bag with the bag neck gathered and a closure placed on the gathered bag neck.
Figure 4:
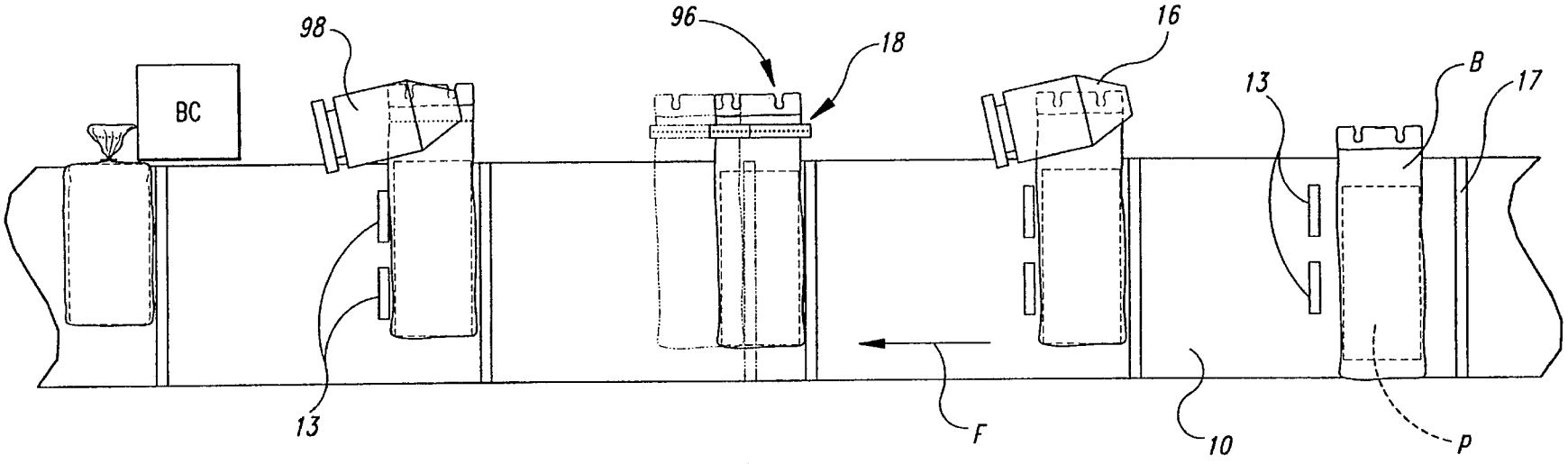
FIG. 4 is a schematic plan view depicting the steps of the method.
Figure 5:
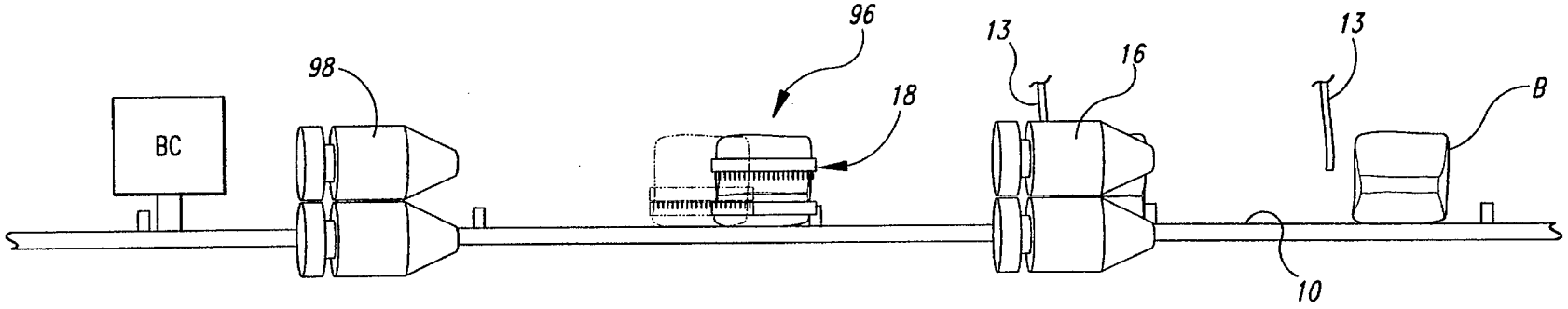
FIG. 5 is a schematic illustration showing the sequence of one embodiment with the sealing spots being made in the bag.

The operation of the apparatus and the method of this invention are best shown in the schematic of FIGS. 4 and 5. While the illustration shows a sealing mechanism of the type shown in FIG. 2, it should be understood that it will also operate in a similar fashion with the sealing mechanism of FIG. 7. The bags B are filled with product P and placed on the conveyor 10. The bags are held in generally transverse alignment on the conveyor by the flights 17 and bars 11 and 13. In some instances the flexible aligning bars 13 which are disposed above the conveyor will gently push the bag with the filled bag back against the flight bar to maintain a straight alignment of the bag as it passes along the conveyor. The bags are moved in the direction of the arrow F, and are engaged by the counter-rotating brushes 16. These brushes draw the open end of the bag upwardly as shown in FIG. 4 or transversely of the conveyor to help pull the bag tight around the product P within the bag. The brushes also tend to flatten the open end of the bag so that the two layers of the bag lay generally flat and in a generally rectangular shape. The conveyor then moves the flattened bag to the sealing mechanism 18 located at a sealing station 96. Here the spots are sealed across the end of the bag as shown in FIG. 1A. The partially sealed bag is then moved further downstream to a second set of brushes 98. The second set of brushes again draws the bag transversely upwardly as shown in FIG. 4 to again tighten the bag around the product in the bag. Downstream of the second set of brushes 98 the bag is delivered to a conventional bag closure BC where the bag neck is gathered as at 99 (FIG. 1B) and a closure or plastic clip 100 is secured around the neck.

As is readily apparent, the invention thus illustrated and described provides for sealing across the open end of a plastic bag with a plurality of fused or welded spots that do not completely seal the open end of the bag. Then the bag neck of the partially sealed open end is subsequently gathered and closed with a removable bag closing device such as a plastic clip. Complete opening of the bag then can be revealed if the welded spots are separated. The spots will separate without disintegrating the entire bag so that once opened, the bag can be reclosed by regathering the neck of the bag and attaching the reusable closing device to the neck of the bag.

While these embodiments of the invention have been illustrated and described, it should be apparent that variations and further equivalents will be readily available to one of ordinary skill in the art. Accordingly, the invention is not to be limited to the specific embodiments illustrated in the drawings.

I claim:

1. Apparatus for sealing a plurality of spaced spots across the mouth of a plastic bag opening, in a bag having an open end with a gatherable neck and a closed end to only delicately seal the bag to show evidence of tampering by breaking the seal but allow the bag to be opened without tearing or destroying the bag, comprising:

a conveyor for moving a plastic bag having a generally flattened open end with a bag opening and containing a product past a sealing mechanism, the bag having two generally flattened layers forming the bag opening;

a sealing mechanism for fastening the two generally flattened layers of the bag flattened open end together at spaced spots across at least part of the generally flattened open end of the bag, the sealing mechanism including spaced sealing members that penetrate through all the layers to form a hole in each layer surrounded by fused material creating only a light gripping seal sufficient only to allow the bag to be opened without tearing or destroying the bag but sufficient to show that the bag has been separated to reveal evidence of tampering wherein the bag opening will remain partially closed by the spots but can be reopened without destroying the bag; and a closure applicator positioned adjacent said conveyor gathering the neck of the bag and placing a releasable closing device around the gathered neck to hold the bag closed as the principal closing device for the bag.

2. The apparatus of claim 1, said sealing mechanism including a movable plate and a platen, a drive unit connected to the movable plate to move it toward the platen and along the conveyor in synchronism with the conveyor, one of said platen and movable plate having a plurality of said sealing members which are spaced heated pins.

3. The apparatus of claim 1, said sealing mechanism having a rotary sealing wheel, the periphery of the sealing wheel having a plurality of said sealing members which are spaced heated points, a drive unit for rotating the sealing wheel so that its points move in the direction of the conveyor in synchronism with the conveyor;

a platen wheel movable in synchronism with the rotary sealing wheel, and said drive unit bringing the heated points successively into contact with the two layers of the plastic bag as the conveyor moves the bag past the sealing wheel and platen wheel to penetrate and weld together spaced spots in the two layers.

4. The apparatus of claim 1, including brushes upstream of the sealing mechanism, the brushes pulling the end of the bag having the bag opening transversely of the conveyor in the direction toward the sealing mechanism.

5. The apparatus of claim 1, including brushes downstream of the sealing mechanism, the brushes pulling the partially sealed bag transversely of the conveyor in the direction toward the closure applicator.

6. The apparatus of claim 2, said drive unit including a cam plate having a continuous groove, a cam follower in the groove, the groove guiding the cam follower to move the movable plate first toward the platen and then in the same direction as the conveyor movement, thence away from the platen and finally back upstream opposite to the conveyor movement.

7. The apparatus of claim 2 or 3 further including brushes downstream of the sealing mechanism to move the partially sealed open end of the bag transversely of the conveyor in the direction of the closure applicator prior to placing the closure on the open end of the bag.

8. The apparatus of claim 1, including flight bars attached transversely to the conveyor for aligning the filled bag on the conveyor, guide bars overlying the conveyor to engage the filled bag and push it against the flight bars, brushes upstream of the sealing mechanism to pull the open end of the bag transversely of the conveyor in the direction toward the sealing mechanism.

9. The apparatus of claim 8, including brushes downstream of the sealing mechanism, the downstream brushes pulling the open end of the partially filled bag transversely of the conveyor in the direction of the closure applicator, the closure applicator placing a closure on the gathered neck of the bag between the sealed spots and the product in the bag to hold the bag tightly closed.

10. The method of delicately sealing the opening of the open end of a filled bag formed of two opposed layers to show evidence of tampering with the contents of the bag if the delicate sealing is broken and then gathering and finally closing the delicately sealed open end of the bag, comprising:

moving a filled bag containing an edible product along a path with the bag having an open end defined by the two layers of the bag extending beyond the edible product, the bag having a forward edge and a rearward edge in the direction of movement along the path, partially sealing the bag open end at a plurality of spaced spots across the open end of the bag from the forward edge to the rearward edge of the bag at a sealing location along the path by penetrating through all layers of the bag with sealing members that fuse spots of the two layers together with only a light holding force insufficient to hold the bag closed if light separating forces are applied to separate the layers of the bag to open the bag and to separate without tearing or destroying the bag if the bag gets opened to enter the bag to gain access to the contents of the bag; and closing the bag opening at the open end of the bag by gathering the delicately sealed open end of the bag and applying a releasable closure to the gathered bag end downstream of the sealing location along the path, the releasable closure being the principal closing force on the bag to keep the bag closed during handling of the bag.

11. The method of claim 10, wherein the removable closure is placed closer to the product than the spaced spots.

12. The method of claim 10, and step of delicately sealing the bag opening including heating all of the spots simultaneously.

13. The method of claim 10, said step of delicately sealing the bag opening including heating the spots successively as the bag is moved along the path.

14. Apparatus for delicately sealing and temporarily closing the opening of the open end of a plastic bag filled with a product and having a neck at the open end that can be gathered and closed to only lightly seal the bag to show evidence of tampering but allow the bag to be opened without tearing or destroying the bag, comprising:

means for conveying a bag having a generally flattened open end along a path;

sealing means adjacent said conveyor for sealing a plurality of alternating spots of light seals and openings spaced from one another across the entire flattened open end of the bag with a sealing adhesion necessary only to retain the bag from opening without tearing the bag and with delicate adhesion to hold the bag lightly closed but allow separation with light force to show if a sealing spot has been separated with the bag not torn to show evidence of tampering; and closing means positioned adjacent said conveying means for gathering the neck of the delicately sealed open end of the bag and applying a releasable closing device on the gathered neck as the principal closure for holding the bag open end closed.

15. The method of partially sealing the opening of the open end of a filled bag and then gathering and closing the partially sealed open end of the bag, comprising:

moving a filled bag containing an edible product along a path with the bag having an open end extending beyond the edible product, the bag having a forward edge and a rearward edge in the direction of movement along the path, partially sealing the bag open end at a plurality of alternating spaced lightly sealed spots and openings across the entire open end of the bag from the forward edge to the rearward edge of the bag at a sealing location along the path, said sealing being provided with an adhesion force sufficient only to hold the bag lightly closed at the spaced spots to allow separation of the sealing spots under light separation force to open the bag and less than the force necessary to tear or destroy the bag so that the sealing spots are not the primary closure for holding the bag open end closed; and closing the bag opening at the open end of the bag by gathering the partially sealed open end of the bag and applying a releasable closure to the gathered bag end downstream of the sealing location along the path as the principal closure for holding the bag closed.

16. The method of claim 15, including the step of placing the alternating spots and openings at a uniform spacing across the entire open end of the bag.

* * * * *